United States Patent [19]

Greenwood

[11] Patent Number: 4,615,181

[45] Date of Patent: Oct. 7, 1986

[54] COOLING APPARATUS FOR AIR CONDITIONING COMPRESSOR EQUIPMENT

[76] Inventor: Robert Greenwood, 5326 Pinewilde Dr., Houston, Tex. 77066

[21] Appl. No.: 766,300

[22] Filed: Aug. 16, 1985

[51] Int. Cl.[4] ..... F28D 5/00

[52] U.S. Cl. ..... 62/279; 62/305

[58] Field of Search ..... 62/305, 171, 272, 309, 62/311, 279

[56] References Cited

U.S. PATENT DOCUMENTS 2,644,321 7/1953 Borgerd ..... 62/305

3,472,042 10/1969 Shriver ..... 62/305

*Primary Examiner*—Henry Bennett

*Attorney, Agent, or Firm*—Gunn, Lee & Jackson

[57] ABSTRACT

An apparatus for lowering the temperature in an air conditioning compressor is set forth. In the preferred and illustrated embodiment, the structure comprises a closed rectangular framework. Across the top, slats are adjusted at an angle to intercept the sun at its summer zenith, thereby shading the top of the equipment. For the sides, water from the evaporator is collected in a sump and is delivered through a header hose along each side. The water drips down slats which are arranged in a staggered arrangement, and the water cools the slats, thereby causing air drawn through the slats to be cooled.

11 Claims, 2 Drawing Figures

SUN 10
14
18
16
14
22
20
24
28
26
12

EVAPORATOR
30
SUMP
32
40
P
TO HEADER HOSE
CONTROL
34
COMPRESSOR COOLING FAN
38
COMPRESSOR
36

COOLING APPARATUS FOR AIR CONDITIONING COMPRESSOR EQUIPMENT

BACKGROUND OF THE INVENTION

This apparatus is a protective device intended for use over and around compressor equipment. In refrigeration systems used for air conditioning purposes, and especially in residences, such systems normally comprising three to six ton units (occasionally running as high as ten tons) there are two sets of equipment. One part of the equipment is located exterior of the building where the heat is rejected. The heat rejection occurs utilizing a compressor which compresses the vaporous refrigerant to form a heated, condensed liquid flow. The liquid is conducted through a heat exchanger and a compressor cooling fan is operated to draw air across the heat exchanger to reject heat to atmosphere. Typically, this equipment (cooling fan, exchanger and compressor) is known as a compressor unit and is located on the exterior of a residence. Sometimes, it is located on the side of the building and sometimes it is located on the roof.

The compressor unit is often located where the sun load is excessive. For instance, on the roof, ambient air temperature of 90° F. may well be accompanied by roof temperatures of about 105° or 110°, and direct sun light falling on the compressor unit may raise the temperature of the quiescent equipment to perhaps 120° or more. When it switches on, the temperature goes even higher because it is then ejecting heat to atmosphere. Excessive ambient temperatures as a result of sun load increase the temperature of the equipment and hence reduce efficiency. This markedly increases energy consumption.

This apparatus sets forth a protective structure which cuts down on heat load at the compressor. It particularly takes advantage of natural air flow which in most compressors draws air in from the sides and ejects heat upwardly out of the compressor. One of the major problem is direct sun light falling on the equipment. This apparatus contemplates an overhead set of slats. They are constructed and arranged whereby the upward air draft is easily passed by the slats. Moreover, the air blast which is ejected is only slightly deflected through an angle which is not severe, and therefore, heat rejection is not impeded.

The apparatus further includes means utilizing condensate collected from the evaporator. In general terms, the evaporator forms condensate on the coils which typically collects in a pan. Moreover, the condensate is typically chilled below ambient air temperature, and it is not uncommon to be in the range of 50°-60° F. This apparatus contemplates collection of the condensate and delivery of the condensate through a small pump to a header hose. The header hose is arranged horizontally beneath a tope edge frame member and drips the slightly chilled water through a number of holes in the header hose onto a set of slats. As described in detail hereinafter, the slats are arranged whereby the water runs down on the slats, picks up air flow through the slats, and cools the air slightly. This air flow is thus introduced into the near vicinity of the compressor equipment, and thereby provides a cooled air flow (with moisture) through the compressor. On a typical hot day of 95° F., the cooling air impinging on the equipment can be chilled, and thereby obtain a large drop. Since the entire equipment is shaded to thereby obtain a reduction in radiant heat transfer, the compressor equipment is then operated with much improved conditions and circumstances whereby the efficiency of the compressor is markedly improved. This not only improves the efficiency of operation, but it also improves the durability of the equipment and reduces the strain which is occasioned by routine operation of the equipment.

An important factor in this equipment is that the compressor is permitted to operate in the ordinary fashion without interfering with its operation other than reducing its load as described herein. That is, the present apparatus is substantially passive insofar as the compressor equipment is concerned.

While the foregoing speaks very generally of the equipment, it is summarized as a cabinet or housing for an externally located compressor unit having a set of slats in the overhead portion positioned and angled to intercept the sun at its summer zenith, thereby protecting the equipment from sun load. Additionally, multiple sides are arranged, each of the sides preferably having a header hose for dripping water from the evaporator onto a set of slats whereby air is drawn through the slats into the equipment for cooling.

BRIEF DESCRIPTION OF THE DRAWINGS

So that the manner in which the above recited features, advantages and objects of the present invention re attained and can be understood in detail, more particular description of the invention briefly summarized above, may be had by reference to the embodiments thereof which are illustrated in the appended drawings, which drawings form a part of this specification. It is to be noted, however, that the appended drawings illustrate only typical embodiments of the invention and are therefore not to be considered limiting of its scope, for the invention may admit to other equally effective embodiments.

The present invention both as to its organization and manner of operation together with further objects and advantages thereof, may best be understood by way of illustration and example of certain embodiments when taken in conjunction with the accompanying drawings in which.

DETAILED DESCRIPTION OF THE PREFERRED EMBODIMENT

Figure 1:
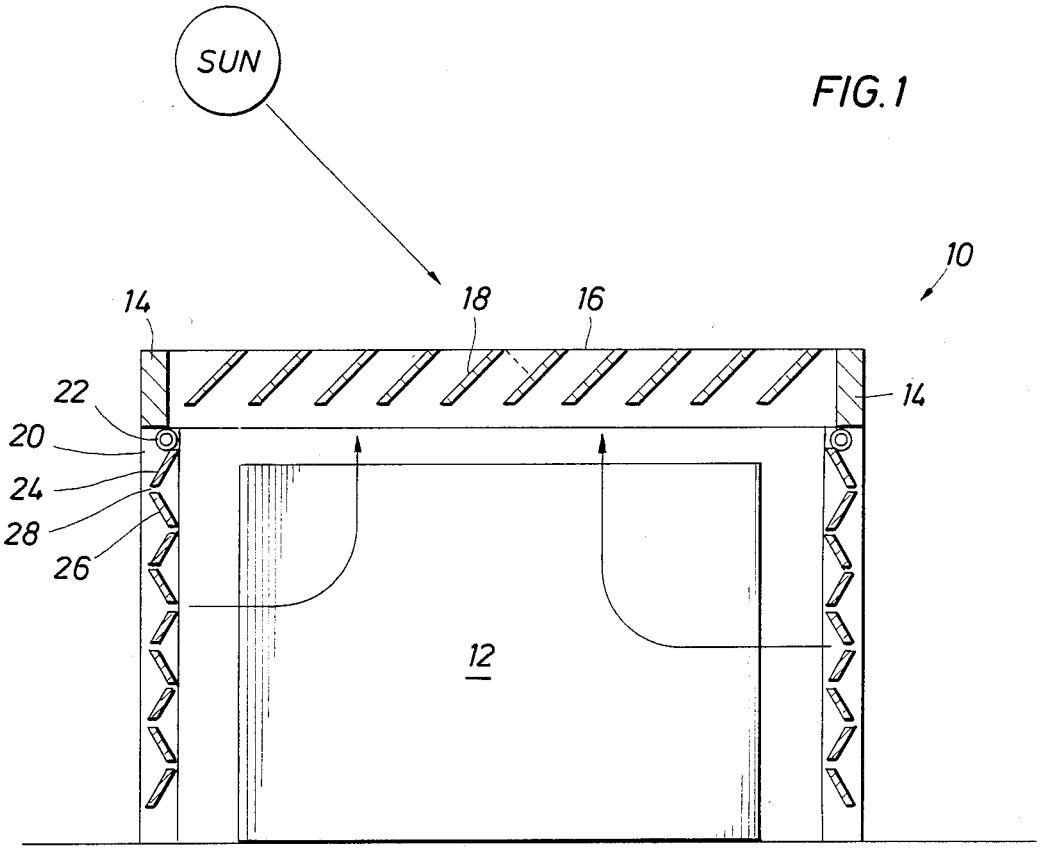
FIG. 1 shows the protective apparatus of this disclosure positioned around compressor equipment for cooling the equipment during operation.

Attention is first directed to FIG. 1 of the drawings where an air conditioning compressor equipment cover is shown. It is identified by the numeral 10. It is located over and around an air conditioning compressor equipment. This is particularly intended for use in home installations and they typically range between 3 and 6 ton sizes. Moreover, it is preferably sized and scaled so that it will cover units of this size. They typically stand between 18 inches and about 4 feet tall. The equipment is formed of a number of walls which are preferably about 6 to 10 inches from the compressor equipment 12. The compressor equipment 12 typically includes a compressor fan which draws air in along the routes indicated by the arrows in FIG. 1. That is, air is drawn through the side and blown upwardly by a fan (within the compressor equipment) which air flow picks up heat and the heat is ejected in the vertical air flow.

The protective apparatus of this disclosure includes a generally rectangular framework at the top. It is formed of parallel sides 14 and similar transverse side members 16. The edges are defined by the sides 14 and 16. The sides enclose a set of louvers or slats 18 which are placed at a common angle. The angle is selected so that the slats provide shade. They are, preferably, relatively wide and widely spaced to leave very large gaps therebetween. This reduces air flow retardation. Moreover, the slats are arranged relative to the summer zenith of the sun such that shade is obtained at the zenith and hence, shade is obtained at other times by generally orienting the slats east and west. That is, they should be positioned so that the slats run approximately parallel to the path of the sun and have an angle such that shade substantially falls on the compressor equipment 12. As will be understood, this is a relatively square or rectangular top surface area which is defined primarily by the spaces between the adjacent slats and hence heat is rejected substantially without restriction to air flow upwardly. The air flow is deflected slightly but is otherwise nearly upwardly.

The equipment may be located so that it requires the structure 10 on all four sides. It may be sufficiently close to a building (not shown) that there is no air flow on that side. For instance, the compressor unit or equipment 12 may draw air in through all four sides. On the other hand, it may draw air in only on three or only two sides. In whatever arrangement is appropriate, it is permissible to use a four-sided structure, as will be described. Alternatively, a three-sided structure can be constructed in accordance with the teachings of this disclosure, which is thereupon positioned adjacent to an adjoining building. If that occurs, the adjoining building serves as the fourth wall, and indeed, might even serve as two walls, depending on building shape. The building wall does not pass air; accordingly, that would be a closed side where air flow would be prevented, but sufficient cooling air can be obtained for the compressor equipment even through only two walls. Therefore, this disclosure contemplates a rectangular structure having four walls but one or two of the walls can be blanked off, meaning that they can have no opening for air flow. This will not interfere with operation of the device.

Each of four walls is thus defined by corner-located rectangular upright framing members 20. The frame members 20 are substantially upright and are typically fabricated of two-by-four stock. They are upright to join with the rectangular frame at the top. On each side, there is a transverse top-edge frame member such as the frame member 14 shown in FIG. 1. It supports with suitable U-shaped staples a header hose 22. The header hose 22 is typically a small-gauge hose in the range of up to about ½ inch O.D. It is located in a gap above a parallel louver 24. There is a gap between the header hose of about 3/16ths to about ½ inch. That is, the header hose defines an air gap just below. The air gap is between the hose 22 and the louver 24. The header hose is perforated with a number of small holes. Water is delivered to the header hose and drips out of the holes and falls downwardly through the space therebelow and lands on the louver 24. The louver 24 is set at an angle. It is preferably rough-cut wood which is not treated, and hence has what might be termed a rather porous exterior. Rather than cutting smooth with milling or sanding, the exterior is preferably quite rough and therefore is able to hold water on its exterior. The louver 24 is thus intentionally rough on the surface so that water holds in the multiple pores of the louver. Moreover, the louver is able to absorb and hold a substantial quantity of water on all surfaces. It is preferably cut so that the surface is relatively absorbent. To this end, it is appropriate to omit various surface finishes such as sealers or lacquers which would otherwise seal the pores of the structure.

An important factor is the position of the louver 24. It is preferably arranged at an angle of about 60° from the vertical. That is, it is slanted so that the two long sides are at about a 60° angle from the vertical. The two edges are preferably cut so that they are approximately in horizontal planes. This presents a more or less horizontal narrow face just below the dripping hose thereabove. This enables the water to form a long, thin, narrow puddle on that face. As the water (dependent on surface tension) accumulates, it ultimately runs over the edge(s) and runs down the long sides of the louver.

The louver 24 is parallel to and just above a similar louver 26. The louvers terminate at facing edges which are quite thin but which are parallel to one another. The louvers are also set at alternating angles. The louver 24, thus, is inclined in one direction and the louver 26 is inclined in the opposite direction. The top edge of the louver 26 is located just below the bottom edge of the louver thereabove. As droplets collect on the bottom edge of the louver 24, they ultimately drip across, bridging the gap 28 between the two louvers. The gap 28 is the gap where air is permitted to flow between the two. The edges which define the gap 28 are thus moist after the device has been in operation for a few minutes.

It will be observed that the arrangement in FIG. 1 depicts alternating louvers. The louvers are arranged so that alternate louvers incline to the right and alternate louvers incline to the left. They are arranged in the fashion of a zig-zag path for water running down the set of louvers. Thus, water delivered through the header hose 24 runs down the several louvers. It is not particularly important that it run on the inside surface or the exterior surface. Water does pass along the various louvers and ultimately falls off the bottom louver. In the arrangement shown in this exemplary structure, there are perhaps between 8 and 12 louvers. Obviously, the number can be increased with height. The number is preferably dependent on the width of the various louvers and the height of the structure. It is preferable to provide alternate louver angular positions of about 60° relative to the vertical. The spacing or gap 28 is about ½ inch. The stock used for louver fabrication can vary in thickness, but the facing edges of adjacent louvers are about ½ inch in width, keeping in mind that the louvers are relatively thin slats or boards which do not have to carry significant weight. It is ideal to fabricate the various louvers parallel with more or less equal spacing of about ½ inch or less.

The gap 28 is thus defined between adjacent louvers to receive water and is therefore washed by the water running down the set of louvers. This reduces the temperature of the air drawn through the gap 28. It will be observed that one header hose is sufficient to provide a more than adequate flow of water which wets the exterior surfaces of substantially all the slats. Ultimately, the water arrives at the bottom and falls off on the adjacent ground. A significant portion of the water is lost in transit. That is, the water is picked up in the air flow, thereby reducing the air temperature and thereby reducing the temperature of the ambient atmosphere adjacent to the compressor equipment. This markedly improves the performance of the equipment.

Figure 2:
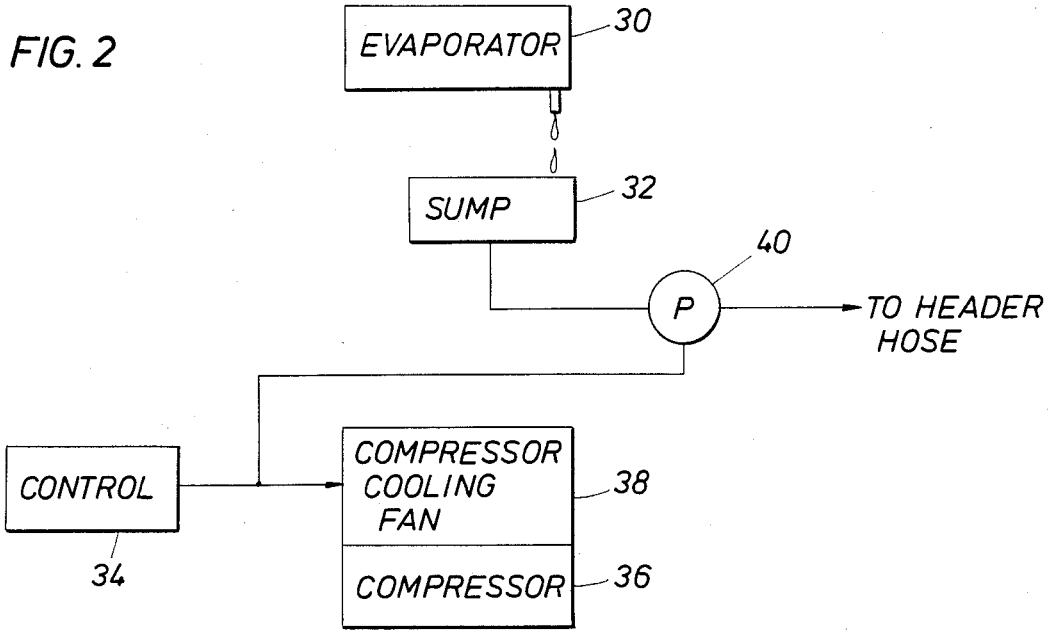
FIG. 2 is a schematic block diagram showing the formation of condensed water and further including a pump and header hose for distribution of the water with the equipment shown in FIG. 1.

As will be recalled from the foregoing discussion, two and sometimes as many as four mutually perpendicular sides define the structure whereby the air flow is directed through the slats or louvers which define the sides. This introduces moistened air to the condensor. In FIG. 2 of the drawings, the refrigeration system includes the evaporator represented in schematic fashion at 30 of the drawings. When it is operative, it forms condensate which collects in a collection pan or other facility which is generally identified as the sump 32. The numeral 34 identifies control equipment for switching the air conditioning equipment on. The control system provides suitable electrical signals for operation of the compressor 36. The compressor 36 typically cooperates with a compressor cooling fan 38. The cooling fan 38 is located in the compressor equipment 12 shown in FIG. 1 for drawing air in and routing the air upwardly for cooling purposes. When a signal is provided indicative of operation of the compressor equipment, it is from the control system 34 furnished to the cooling fan 38. The cooling fan 38 is turned on by suitable electrical signal provided to it. This signal is provided in parallel to a pump 40 which is also switched on. The pump has an inlet connected to the sump 32. It delivers water under pressure to the header hose. One or more header hoses is included around the equipment and they are conveniently connected to the pump 40 so that they are all provided with water flow of a sufficient volume. The rate of flow of water is quite small, but it is more than sufficient to wet the exterior surfaces of the louvers and thereby provide cooling.

The water has an advantage if it is obtained from the evaporator in that it is cooled below the ambient air temperature. Makeup water can be added to the sump in the event that it is unusually dry. Once water is provided on the exterior of the louvers and hence provides a chilling effect on the air flow, interruption of the water flow (as, for example, by depletion of the water supply in the sump) will not particularly interfere with operation. Once the boards are wet, they absorb and hold water. Even if the header hose runs dry, the louvers remain wet for a period of time whereby the air flow through the several louvers is able to chill the air impinging on the compressor equipment and thereby provide more efficient operation of the equipment.

As mentioned earlier, the louver arrangement is ideally included on every side where air flow is required. To the extent that air flow is not needed or that adequate air is introduced through only one or two sides, the other sides can be blanked off as, for instance, by construction with a solid wall or by positioning the protective equipment of this disclosure against adjacent buildings or structures.

This apparatus can be assembled in multiple components as, for instance, by fabrication of individual sides (typically four being required for a structure) and separate fabrication of the louvered top. The four sides and top can be then be assembled quickly and readily by simple fasteners. It is not necessary to make the structure leakproof around the edges or to otherwise provide expensive construction techniques. Rather, the device can be built in relatively simple fashion utilizing wood which provides a relatively rough surface so that water is held by the various louvers.

While the foregoing is directed to the preferred embodiment, the scope is determined by the claims which follow:

What is claimed is:

1. Apparatus for improving the efficiency of compressor equipment potentially exposed to a sun load comprising:

(a) a framework surrounding a compressor equipment;

(b) a plurality of horizontal louvers arranged to define gaps therebetween wherein said louvers are formed of and have a fibrous exposed external surface, and wherein said louvers are substantially parallel and alternate in angular position, and have edges spaced adjacent to one another so that water falling on the topmost louver can run to the next louver and then to the next;

(c) water distribution means including header hose means extending above said louvers and having a plurality of hole means therein for dripping water on said louvers to wet the surfaces of said louvers so that air passing said louvers is cooled by water thereon; and (d) means above said compressor equipment including sun-oriented slats located to intercept the summer zenith sun burden on the compressor equipment absent the present structure.

2. The apparatus of claim 1 wherein said means includes a set of slats having a generally east, west orientation and which slats are angularly positioned so that they maintain the structure therebelow in the shade, said slats being positioned to intercept the sun at the maximum summer zenith.

3. The structure of claim 1 wherein the apparatus includes four sides and the four sides each have individual header hoses means and air is drawn through the four sides, and all the four sides have parallel sets of louvers.

4. The apparatus of claim 3 wherein said louvers are substantially parallel and alternate in angular position, and have edges spaced adjacent to one another so that water falling on the topmost louver can run to the next louver and then to the next.

5. The apparatus of claim 4 wherein said louvers are inclined at an angle of about 60° from the vertical.

6. The apparatus of claim 5 wherein said louvers are formed of wooden boards having a rough cut surface thereon.

7. The apparatus of claim 1 including:

(a) pump means having an inlet and an outlet;

(b) means connecting the inlet of said pump to a sump associated with the air conditioning apparatus to collect condensate from the evaporator thereof; and (c) said pump means having an outlet for delivery of water obtained from said sump into a header hose.

8. The apparatus of claim 1 wherein said louvers are inclined at an angle of about 60° from the vertical.

9. The apparatus of claim 6 wherein said louvers are formed of wooden boards having a rough cut surface thereon.

10. The apparatus of claim 9 wherein said means includes a set of slats having a generally east, west orientation and which slats are angularly positioned so that they maintain the structure therebelow in the shade, said slats being positioned to intercept the sun at the maximum summer zenith.

11. The apparatus of claim 10, including a surrounding top-located framework portion supporting said slats.

* * * * *